US007175306B2

(12) United States Patent
Pan

(10) Patent No.: US 7,175,306 B2
(45) Date of Patent: Feb. 13, 2007

(54) LED ILLUMINATING MODULE

(76) Inventor: Frank Pan, 1752 Redding Ave., Rosemead, CA (US) 91770

( * ) Notice: Subject to any disclaimer, the term of this patent is extended or adjusted under 35 U.S.C. 154(b) by 208 days.

(21) Appl. No.: 10/796,737

(22) Filed: Mar. 8, 2004

(65) Prior Publication Data

US 2005/0195602 A1 Sep. 8, 2005

(51) Int. Cl.
*F21V 5/00* (2006.01)

(52) U.S. Cl. ..... 362/245; 362/240; 362/247

(58) Field of Classification Search ..... 362/240, 362/241, 247, 249, 267, 313, 510, 800, 296
See application file for complete search history.

(56) References Cited

U.S. PATENT DOCUMENTS 5,655,830 A * 8/1997 Ruskouski ..... 362/240
5,934,798 A * 8/1999 Roller et al. ..... 362/497
6,019,488 A * 2/2000 Hastings ..... 362/374
6,641,284 B2 * 11/2003 Stopa et al. ..... 362/240
6,880,952 B2 * 4/2005 Kiraly et al. ..... 362/218
2005/0013131 A1 * 1/2005 Pan et al. ..... 362/225
2005/0128744 A1 * 6/2005 You et al. ..... 362/241

* cited by examiner

*Primary Examiner*—Renee Luebke
*Assistant Examiner*—Zahra I. Bennett
(74) *Attorney, Agent, or Firm*—Raymond Y. Chan; David and Raymond Patent Group

(57) ABSTRACT

A LED illuminating module includes a supporting frame and an illuminating unit. The supporting frame has a top surface and an elongated reflective channel indented on the top surface and defining a peripheral reflective wall inclinedly extended from a bottom wall of the reflective channel. The illumination unit includes a light circuit supported by the supporting frame and a plurality of illuminators which are electrically mounted to the light circuit and spacedly aligned along the reflective channel, wherein each of the illuminators forms as a point of light source for radially emitting light towards the reflective wall, such that the reflective wall is adapted for reflectively accumulating the lights of the illuminators within the reflective channel, so as to merge the points of light source to form a line of light source along the reflective channel.

8 Claims, 4 Drawing Sheets

LED ILLUMINATING MODULE

BACKGROUND OF THE PRESENT INVENTION

1. Field of Invention

The present invention relates to a lighting device, and more particularly to a Light Emitting Diode (LED) illuminating module which is capable of generating a line of light source from a plurality of discrete points of light sources.

2. Description of Related Arts

Fluorescent lamps have long been utilized for a wide variety of lighting purposes, notably for advertisements and domestic use. People prefer fluorescent lamps to traditional light bulbs because they are generally more long-lasting and brighter when compared with traditional light bulbs. Moreover, each of such fluorescent lamps is capable of producing a line light source which is more preferable for practical use. For example, when a particular trademark has to be lightened, fluorescent lamps are suitable for generating consistent line of light of different shapes.

Yet in order to further enhance the lighting performance of the conventional fluorescent lamps, there exist some kinds of neon lights which are capable of producing high intensity of light from a line source. Such kinds of neon lights have successfully accomplished the task of producing high quality of light from consistent line sources. For example, a prominent US city where a substantial amount of neon lights have been utilized for advertisements is Las Vegas in the state of Nevada.

Despite the advantages and popularity of the conventional fluorescent lamps and neon lights, they definitely have discrepancies. First of all, a practical disadvantage of them is that they are generally fragile. As a matter of fact, almost all of the fluorescent lamps have an outer light tube which is generally made of transparent materials, such as glass. As a result, although the outer light tube is good for light transmission, it is fragile and vulnerable to external forces.

Second, conventional neon lights and fluorescent lamps will generate a substantial amount of heat when operating and therefore inevitably produce a substantial amount of energy waste. Although one might argue that the fluorescent lamps, when compared with conventional light bulbs, have already saved a lot of energy and produced a reduced amount of heat when operating. Nonetheless, the fact that the fluorescent lamps produce less amount of heat as compared with conventional light bulbs does not mean that the relevant problem is effectively remedied.

In addition, conventional fluorescent lamps will develop a substantial potential difference between their respective terminals so as to create a great risk to their user. When electricity leak occurred, the consequence would be catastrophic.

Moreover, the substantial potential difference, from engineering point of view, is created by electrons movement between the two terminals. As a result, when the fluorescent lamps are operating, they tend to be unstable in that a light pattern generated by the fluorescent lamp may follow the path of the electrons movement, thus creating a changing light pattern. This is especially true when the fluorescent lamp is nearly put of its product life-time.

Due to the above discrepancies, there exists another type of illuminating device which is generally called the Light Emitting Diode (LED). Conventionally, each LED is capable of generating light in a very efficient manner. It consumes less energy than conventional neon lights and fluorescent lamps, usually non-fragile, and generates only very little amount of heat when operating. One reason for this is that for LED, most energy inputted will be converted into light (i.e. electromagnetic wave with visual wavelength). Thus, as most energy inputted is converted into light, less heat is generated. Thus, LED seems to be a perfect substitute for the conventional neon lights and fluorescent lamps.

Nothing is perfect, however. A fatal disadvantage of LED is a by-product of the above-mentioned advantages. If one is trying to ask why LED consumes less energy, a probable answer might be that because LED produces lower light intensity. As a result, it is a usual practice that a plurality of LEDs is chained together to form a rope light or some other forms of illuminating devices for producing a desirable light effect. However, since each LED can only produce light from essentially a point source, when a plurality of LEDs is chained together, illumination of unsatisfactory pattern may be produced. Generally speaking, light of irregular pattern, meaning that it is not the kind of light coming from a point source nor a line source, ultimately results.

Technically, a point source of light would produce light which is radially extended therefrom to form a spherical pattern. On the other hand, a line source of light would produce light which is extended to form a cylindrical pattern. Thus, where a plurality of LEDs is chained together, the resulting light produced is not wholly spherical nor cylindrical. This produces unsatisfactory illumination effect for such conventional illuminating devices as rope light or light strip.

SUMMARY OF THE PRESENT INVENTION

A main object of the present invention is to provide an LED illuminating module which is capable of generating a line of light source from a plurality of discrete points of light sources, such as those from a plurality of Light Emitting Diodes (LEDs).

Another object of the present invention is to provide a LED illuminating module comprising a supporting frame having an elongated reflective channel which is adapted to optically accumulate light from a plurality of discrete point sources, such as those from a plurality of LEDs, to form a single line source.

Another object of the present invention is to provide a LED illuminating module which is adapted to generate a simple line source of light, and which is simple in structure, non-fragile, consumes less energy as compared with conventional neon lights and fluorescent lamps, and generate less heat when operating.

Another object of the present invention is to provide a LED illuminating module several of which joining together is capable of forming a flexible line source of light so as to provide flexible illumination pattern in different circumstances.

Another object of the present invention is to provide a LED illuminating module which does not involve any expensive or complicated electrical or mechanical components so as to minimize the manufacturing cost and the ultimate selling price of the present invention.

Accordingly, in order to accomplish the above objects, the present invention provides a LED illuminating module, comprising:

a supporting frame having a top surface and an elongated reflective channel indented on the top surface and defining a peripheral reflective wall inclinedly extended from a bottom wall of the reflective channel; and an illumination unit comprising a light circuit supported by the supporting frame and a plurality of illuminators which are electrically mounted to the light circuit and spacedly aligned along the reflective channel, wherein each of the illuminators forms as a point of light source for radially emitting light towards the reflective wall, such that the reflective wall is adapted for reflectively accumulating the lights of the illuminators within the reflective channel, so as to merge the points of light source to form a line of light source along the reflective channel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
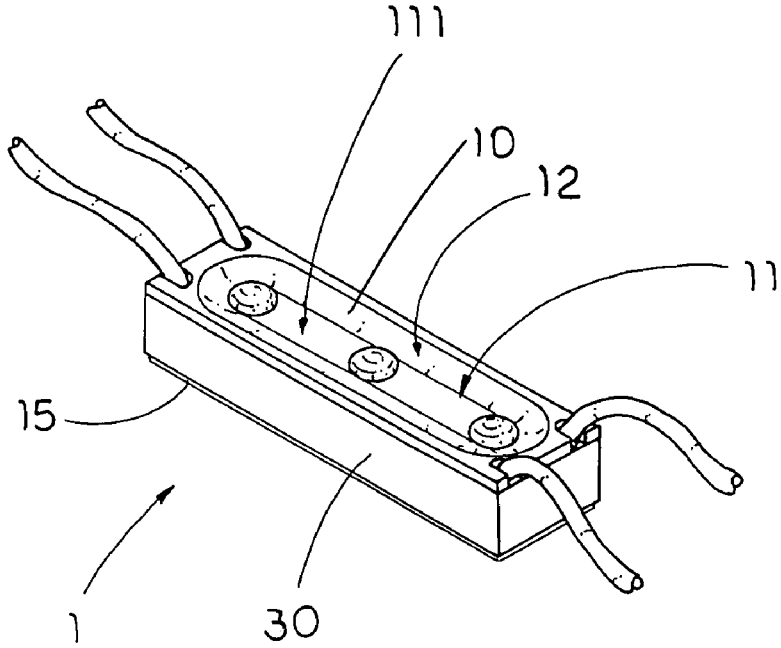
FIG. 1 is a perspective view of an illuminating module according to a preferred embodiment of the present invention.

Referring to FIG. 1 of the drawings, a Light Emitting Diode (LED) illuminating module 1 according to a preferred embodiment of the present invention is illustrated, in which the illumination module 1 comprises a supporting frame 10 and an illumination unit 20.

The supporting frame 10, which is made of non-fragile materials such as plastic materials, has a top surface and an elongated reflective channel 11 which is indented on the top surface and defines a peripheral reflective wall 12 inclinedly extended from a bottom wall 111 of the reflective channel 11.

The illumination unit 20 comprises a light circuit 22 supported by the supporting frame 10, and a plurality of illuminators 21 which are electrically mounted to the light circuit 22 and spacedly aligned along the reflective channel 11, wherein each of the illuminators 21 forms a point of light source for radially emitting light towards the peripheral reflective wall 12, such that the peripheral reflective wall 12 is adapted for reflectively accumulating the light of each of the illuminators 21 within the peripheral reflective channel 11, so as to merge the points of light sources to form a line of light source along the reflective channel 11.

Figure 2A:
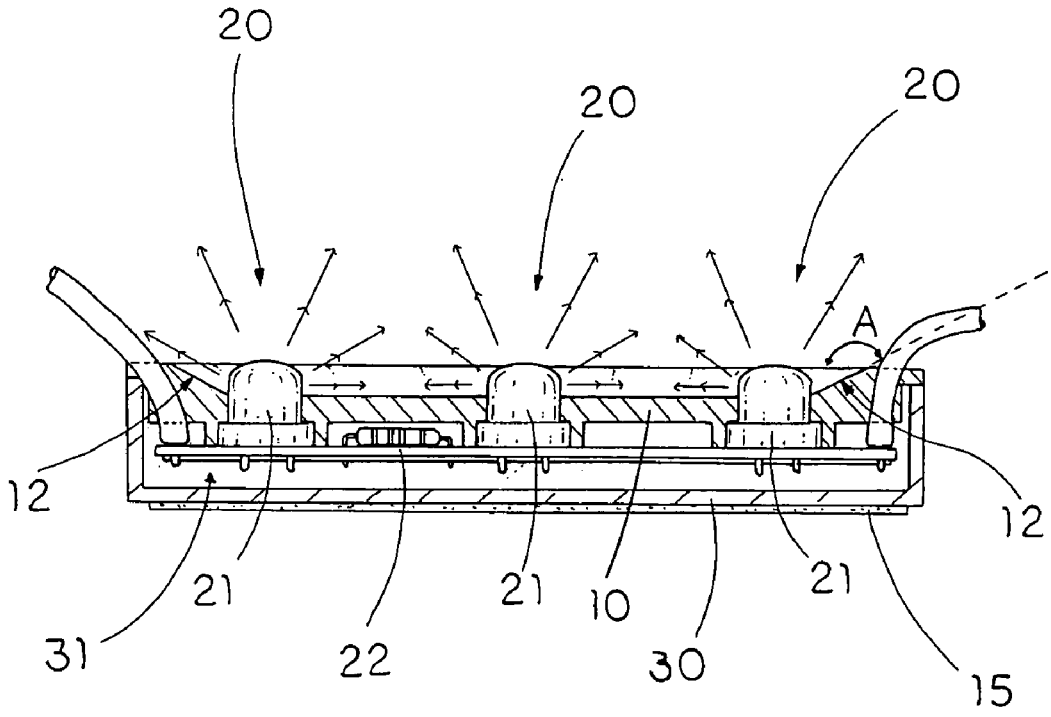
FIG. 2A and FIG. 2B are sectional side views of the illuminating module according to the above preferred embodiment of the present invention.
Figure 2B:
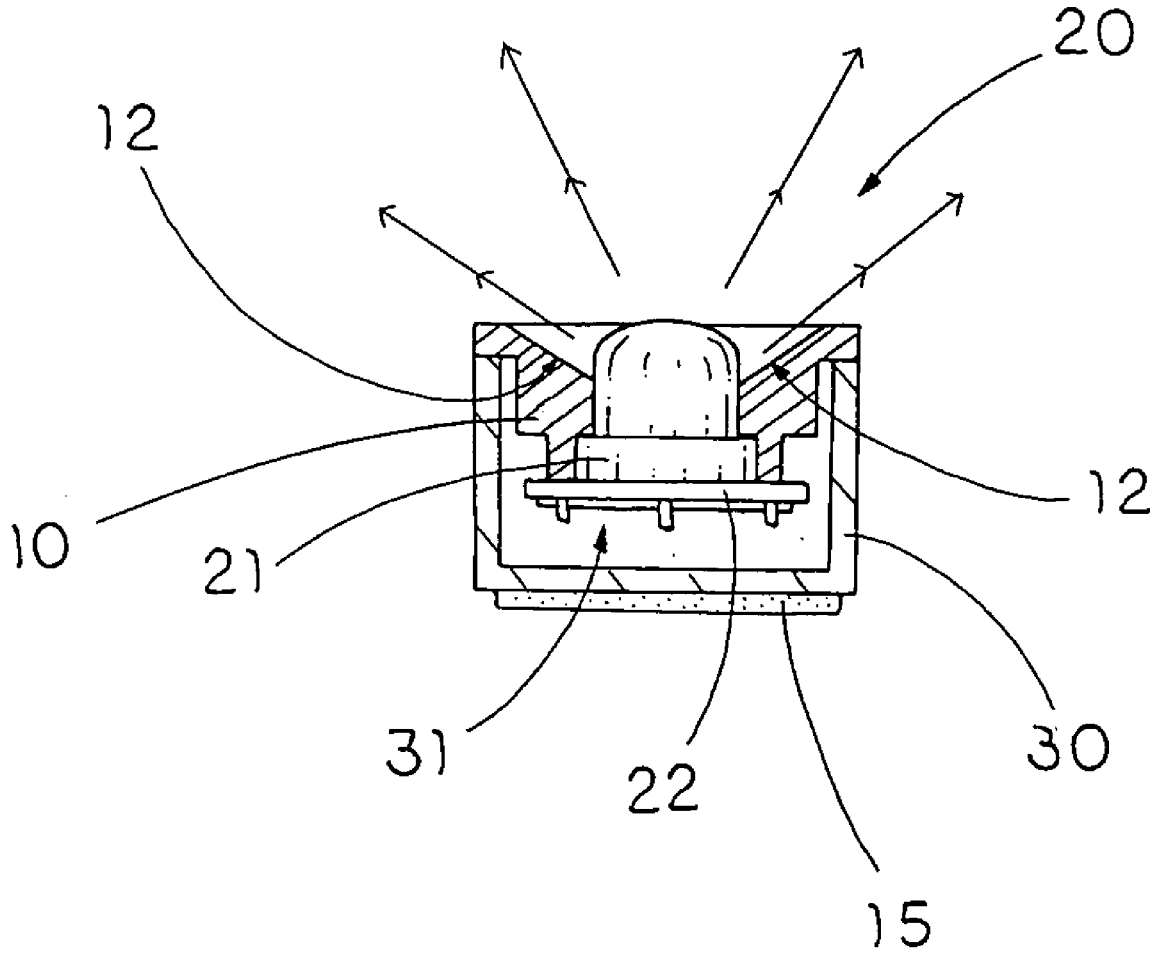

Referring to FIG. 2A and FIG. 2B of the drawings, the reflective wall 12 is inclinedly and outwardly extended from the bottom wall 111 of the reflective channel 11 to the top surface of the supporting frame 10 such that when each of the illuminators 21 radially emits the light, the light is reflected at the reflective wall 12 towards the reflective channel 11 so as to accumulate the lights from the illuminators 21 within the reflective channel 11. In other words, the reflective wall 12 enhances the light intensity of each of the illuminators 21 within the reflective channel 11 to form the line of light source.

The reflective wall 12 is continuously extended to surround the reflective channel 11 for reflectively accumulating light coming from each of the illuminators 21 in a predetermined manner so as to form the line of light source. According to the preferred embodiment, the reflective wall 12 is inclined at a predetermined reflective inclination angle A with respect to the bottom wall 111 wherein the reflective inclination angle A corresponds with a projecting angle of light of the plurality of the illuminators 21.

The LED illuminating module 1 further comprises a sealing housing 30 sealedly mounted underneath the supporting frame 10 so as to define a receiving cavity 31 therewithin for receiving the light circuit 22 in a sealed manner so as to be supported by the supporting frame 10. When each of the illuminators 21 is spacedly supported at the light circuit 22 which is received in the sealing housing 30 and supported by the supporting frame 10, a head portion of each of the illuminators 21 is arranged to be outwardly protruded from the top surface of the supporting frame 10 while disposing within the reflective channel 11.

Accordingly, the supporting frame 10 further has a plurality of guiding through holes spacedly formed on the top surface wherein the head portions of said illuminators 21 are protruded from the receiving cavity 31 of the sealing housing 30 to the reflective channel 11 through the guiding through holes respectively so as to retain the illuminators 21 in position. As a result, the illuminators 21 are capable of generating illumination in the reflective channel 11 which optically accumulates the light from the point sources to become a line of light source for providing a line source of light to a user of the present invention.

According to the preferred embodiment, the illuminators 21 are preferably embodied as a plurality of regular Light Emitting Diodes (LEDs) each having a predetermined color of illumination, and is spacedly mounted by the supporting frame 10 in the reflective channel 11 in such a manner that each illuminator 21 is arranged to optically communicate with each other to form the line of light source.

It is worth mentioning that the illuminators 21, being a plurality of LEDs, are conventionally capable of emitting light in an angle of approximately 120° (the projecting angle) radially from the respective LED. As a result, in order to optically accumulate the light from each LED to form a line of light source, the reflective inclination angle A is preferably preferably larger than 90° and smaller than 180° with respect to the bottom wall 111 of the reflective channel 11.

Accordingly, the light circuit 22 comprises a IC board sealedly supported within the receiving cavity 31 wherein a leg portion of each of the illuminators 21 is electrically mounted on the light circuit 22 such that when the light circuit 22 is electrically connected to a power source, the illuminators 21 are electrically connected to radially emit the lights towards the reflective wall 12.

Moreover, in order to ensure sound accumulation of light, the bottom wall 111 is preferably flat in the sense that it should have no inclination with respect to the horizontal. In other words, light emitting from the plurality of illuminators 21 are reflected in the reflective channel 11 which has a preferred geometry in a predetermined manner for forming a single line of light source from the LED illuminating module 1. In other words, the bottom wall 111 of the reflective channel 11 is a flat surface adapted for reflectively accumulating the lights from the illuminators 21 within the reflective channel 11, so as to enhance the points of light source to be merged to form a line of light source along the reflective channel 11.

In order to enhance the reflecting quality of the supporting frame 10, the supporting frame 1 further has a light reflective layer coated on the bottom wall 111 and the side reflective wall 12 of the reflective channel 11 for enhancing the reflection performance of the light in the reflective channel 11. It is worth pointing out that since the single line of light source of the present invention is derived by multiple reflections taken place in the reflective channel 11, it is of utmost importance in maintaining sound reflectivity of the bottom wall 111 and the peripheral reflective wall 12. That's why the light reflective layer. It is preferably embodied as a reflective coating, such as a sliver coating, having a predetermined reflectivity for multiple reflecting lights in the reflective channel 11 to form a line of light source by subsequent interferences between the reflecting light.

Figure 3:
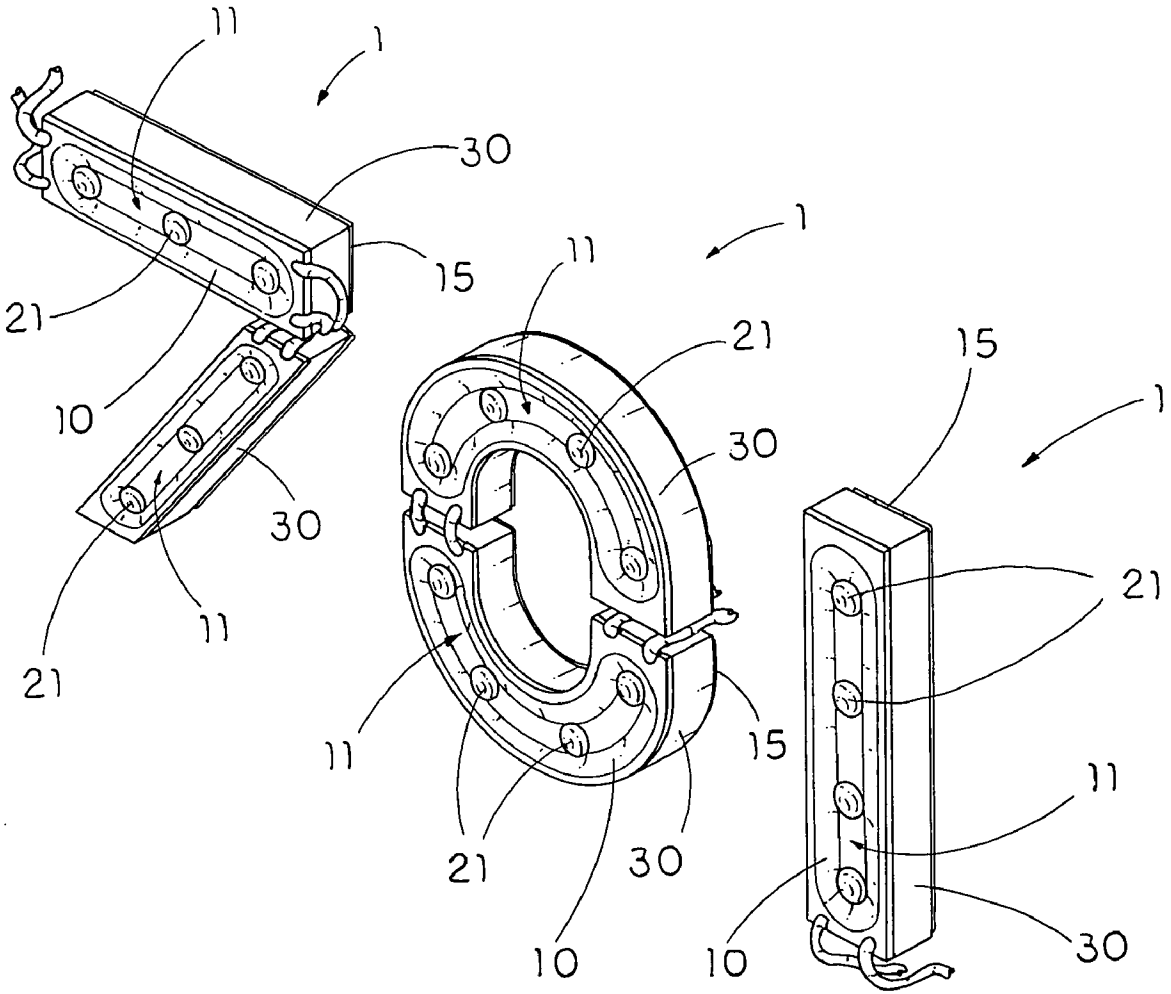
FIG. 3 is a schematic diagram of a plurality of illuminating module according to the above preferred embodiment of the present invention, illustrating a practical application of the illuminating modules.

Referring to 3 of the drawings, some applications of the LED illuminating module 1 of the present invention are schematically illustrated, in which a plurality of LED illuminating modules 1 are electrically connected together to form a particular illuminating pattern, such as '701' shown in the FIG. 3. It is definitively noteworthy that since each particular LED illuminating module 1 is capable of emitting a line of light source per se, when more than one of those are electrically connected together with flexible electrical wires, they are capable emitting a prolonged line of light source which fit for different environment, such as for advertisement purpose.

Figure 4:
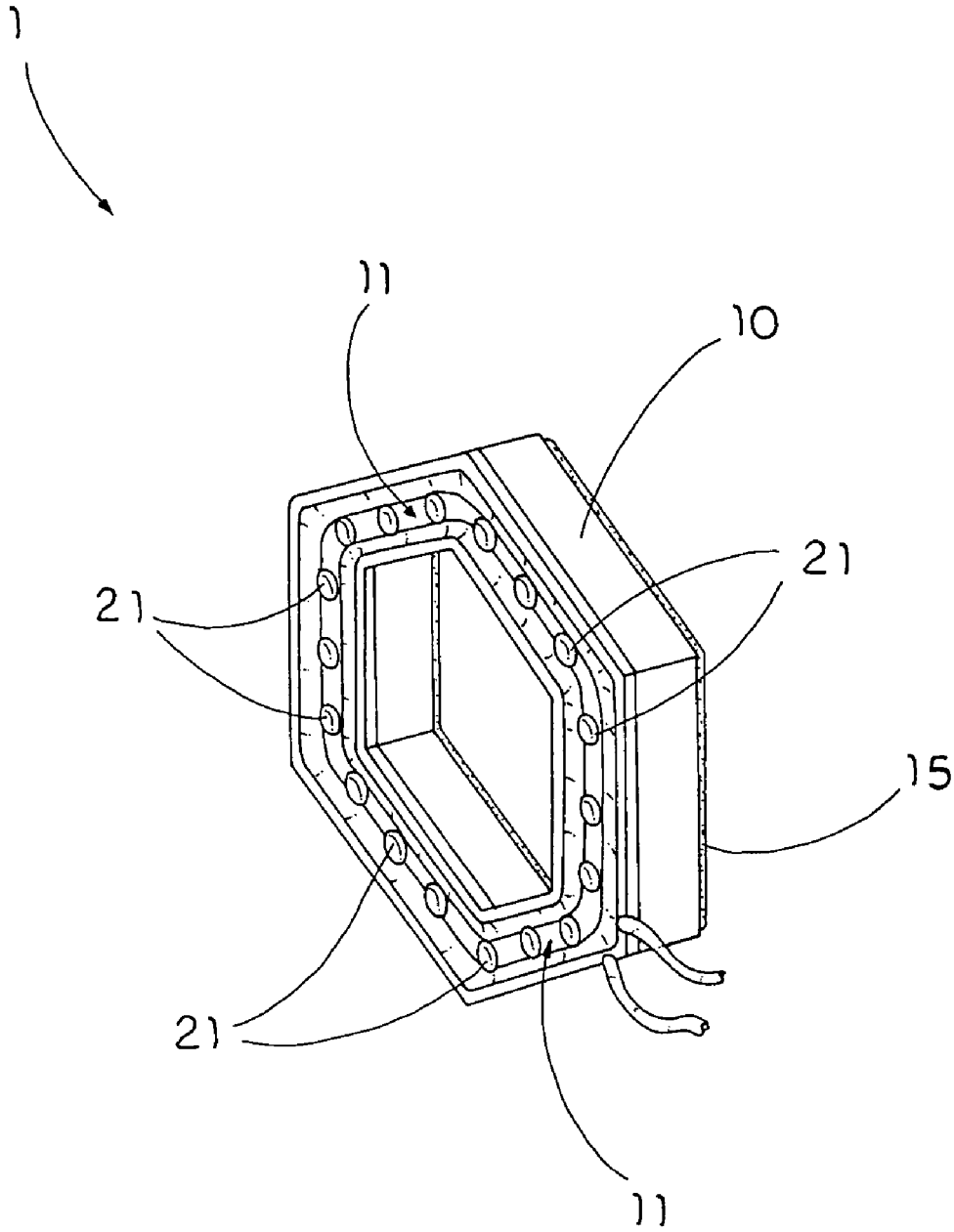
FIG. 4 is a second schematic diagram of the plurality of illuminating module according to the above preferred embodiment of the present invention, illustrating a practical application of the illuminating modules.

As a further example, as shown in FIG. 4 of the drawings, the LED illuminating module 1 may be embodied as a regular hexagon wherein the supporting frame 10 is embodied as an integral hexagon. Then, the LED illuminating module 1 can be used for desired utilization.

Accordingly, the LED illuminating module 1 may further comprise means 15 for attaching the supporting frame 10 onto a fixture such that the whole chain of LED illuminating modules 1 is capable of producing a line of light source which is flexible, non-fragile, less energy consumption, and less heat generation. The attaching means 15 is preferably embodied as an adhesive layer attached at an outer side of the bottom wall 111 of the supporting frame 10 for securely adhering the supporting frame 10 on to, say, a wall, or a billboard. Alternatively, the attaching means 15 may be conventional screws or similar connectors which are capable of attaching the supporting frame 10 onto a fixture.

Alternatively, the supporting frame 10 of the LED illuminating module 1 may be fabricated into various shapes so as to fit different surrounding circumstances in which they are utilized. For example, a circular supporting frame 10 may be utilized for representing the character 'O'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A Light Emitting Diode (LED) illuminating module, comprising:

a supporting frame having a top surface and an elongated reflective channel indented on said top surface and defining a peripheral reflective wall inclinedly extended from a bottom wall of said reflective channel;

an illumination unit comprising a light circuit supported by said supporting frame and a plurality of illuminators which are electrically mounted to said light circuit and spacedly aligned along said reflective channel, wherein a head portion of each of said illuminators is outwardly protruded from said top surface of said supporting frame to dispose within said reflective channel, wherein each of said illuminators forms as a point of light source for radially emitting light towards said reflective wall, such that said reflective wall reflectively accumulates said lights of said illuminators at radial direction within said reflective channel, so as to merge said points of light source to form a line of light source along said reflective channel for illumination; and a sealing housing sealedly mounted below said supporting frame to define a receiving cavity therewithin to sealedly receive said light circuit.

2. The LED illuminating module, as recited in claim 1, wherein said supporting frame further has a plurality of guiding through holes spacedly formed on said top surface such that said head portions of said illuminators are protruded from said receiving cavity of said sealing housing to said reflective channel through said guiding through holes respectively so as to retain said illuminators in position.

3. A Light Emitting Diode (LED) illuminating module, comprising:

a supporting frame having a top surface and an elongated reflective channel indented on said top surface and defining a peripheral reflective wall inclinedly extended from a bottom wall of said reflective channel;

an illumination unit comprising a light circuit supported by said supporting frame and a plurality of illuminators which are electrically mounted to said light circuit and spacedly aligned along said reflective channel, wherein a head portion of each of said illuminators is outwardly protruded from said top surface of said supporting frame to dispose within said reflective channel, wherein each of said illuminators forms as a point of light source for radially emitting light towards said reflective wall, such that said reflective wall reflectively accumulates said lights of said illuminators at radial direction within said reflective channel, so as to merge said points of light source to form a line of light source along said reflective channel for illumination, wherein said reflective wall has a height allowing said reflective wall to reflect said light from each of said illuminators radially projecting to said reflective wall, such that said reflective wall is adapted for reflectively accumulating said lights of said illuminators at radial direction within said reflective channel, wherein said reflective wall, having a reflective inclination angle corresponding with a projecting angle of each of said illuminators, is continuously extended to surround said reflective channel as a peripheral sidewall thereof to reflectively accumulate said lights of said illuminators within said reflective channel; and a sealing housing sealedly mounted below said supporting frame to define a receiving cavity therewithin to sealedly receive said light circuit.

4. A Light Emitting Diode (LED) illuminating module, comprising:

a supporting frame having a top surface and an elongated reflective channel indented on said top surface and defining a peripheral reflective wall inclinedly extended from a bottom wall of said reflective channel;

an illumination unit comprising a light circuit supported by said supporting frame and a plurality of illuminators which are electrically mounted to said light circuit and spacedly aligned along said reflective channel, wherein a head portion of each of said illuminators is outwardly protruded from said top surface of said supporting frame to dispose within said reflective channel, wherein each of said illuminators forms as a point of light source for radially emitting light towards said reflective wall, such that said reflective wall reflectively accumulates said lights of said illuminators at radial direction within said reflective channel, so as to merge said points of light source to form a line of light source along said reflective channel for illumination, wherein said reflective wall has a height allowing said reflective wall to reflect said light from each of said illuminators radially projecting to said reflective wall, such that said reflective wall is adapted for reflectively accumulating said lights of said illuminators at radial direction within said reflective channel, wherein said reflective wall, having a reflective inclination angle corresponding with a projecting angle of each of said illuminators, is continuously extended to surround said reflective channel as a peripheral sidewall thereof to reflectively accumulate said lights of said illuminators within said reflective channel, wherein said reflective inclination angle of said reflective wall is larger than 90° and smaller than 180° with respect to said bottom wall of said reflective channel, wherein said bottom wall of said reflective channel is a flat surface adapted for reflectively accumulating said lights from said illuminators within said reflective channel, so as to enhance said points of light source to be merged to form said line of light source along said reflective channel; and a sealing housing sealedly mounted below said supporting frame to define a receiving cavity therewithin to sealedly receive said light circuit.

5. The LED illuminating module, as recited in claim 4, wherein said supporting frame further has a light reflective layer coated on said peripheral side wall and said bottom wall to form said reflective channel.

6. The LED illuminating module, as recited in claim 5, wherein said supporting frame further has a plurality of guiding through holes spacedly formed on said top surface such that said head portions of said illuminators are protruded from said receiving cavity of said sealing housing to said reflective channel through said guiding through holes respectively so as to retain said illuminators in position.

7. The LED illuminating module, as recited in claim 4, wherein said supporting frame further has a plurality of guiding through holes spacedly formed on said top surface such that said head portions of said illuminators are protruded from said receiving cavity of said sealing housing to said reflective channel through said guiding through holes respectively so as to retain said illuminators in position.

8. The LED illuminating module, as recited in claim 7, further comprising means for electrically connecting said light circuit to a power source.

* * * * *